United States Patent [19]

Surber

[11] Patent Number: 4,738,486

[45] Date of Patent: Apr. 19, 1988

[54] WATER-FILLED SITTING FURNITURE

[76] Inventor: Keith V. Surber, R.R. 1, What Cheer, Iowa 50268

[21] Appl. No.: 940,939

[22] Filed: Dec. 12, 1986

[51] Int. Cl.[4] ..... A47C 3/00

[52] U.S. Cl. ..... 297/284; 297/454; 297/455; 297/DIG. 3

[58] Field of Search ..... 297/284, 455–456, 297/DIG. 3, 454; 5/422, 446, 449, 445; 128/450, 451, 452, 455; 251/4, 7, 9, 10

[56] References Cited

U.S. PATENT DOCUMENTS

| | | | |
|---|---|---|---|
| 2,245,030 | 6/1941 | Gottesfeld et al. | 251/7 |
| 2,684,672 | 7/1954 | Summerville | 128/33 |
| 3,196,868 | 7/1965 | Johnston | 297/284 |
| 3,265,438 | 8/1966 | Regan et al. | 297/DIG. 3 |
| 3,608,961 | 9/1971 | Von Heck | 297/284 |
| 4,143,909 | 3/1979 | McFarlin | 297/284 |
| 4,145,083 | 3/1979 | Urban | 297/284 |
| 4,233,492 | 11/1980 | McMullan et al. | 5/422 |
| 4,370,769 | 2/1983 | Herzig et al. | 297/DIG. 3 |
| 4,391,466 | 7/1983 | Smith | 297/DIG. 3 |
| 4,514,010 | 4/1985 | Gonzalez | 297/284 |
| 4,532,662 | 8/1985 | Sama | 5/450 |
| 4,569,502 | 2/1986 | Elliott | 251/7 |
| 4,623,192 | 11/1986 | Teruhiko et al. | 297/284 |

*Primary Examiner*—James T. McCall

*Attorney, Agent, or Firm*—Zarley McKee, Thomte, Voorhees & Sease

[57] ABSTRACT

The water-filled chair or couch of the present invention includes a frame, and a bladder positioned on the frame. The bladder has a seat portion, a back portion, and a channel extending substantially across the width of the bladder so as to provide communication between the seat and back portions. The bladder is partially filled with water and is void of air such that, as a person sits down into the chair, water is forced substantially instantaneously from the seat portion through the channel and upwardly into the back portion of the bladder which expands to provide support to the person's lower back. The channel has a depth substantially less than that of the seat or back portions. A restrictor bar extends across the channel to maintain the shape thereof as water passes therethrough. A dam is provided at least on the front edge of the bladder to provide support thereto. A heating element and vibrator are provided for additional comfort.

12 Claims, 2 Drawing Sheets

WATER-FILLED SITTING FURNITURE

BACKGROUND OF THE INVENTION

Conventional chairs and couches utilize springs and/or stuffing in the cushions to provide a comfortable, yet supportive, place to sit for a person. However, after extended use, such furniture develops depressions, or sags where the person normally sits. Furthermore, the firmness of conventional chairs and couches cannot be adjusted to suit individual desires.

Attempts have been made to produce chairs and couches having water-filled cushions, similar to water beds. However, this water furniture typically has the wave effect common in many water beds. That is, when a person sits in the chair, the water in the seat cushion continues to move within the cushion, thereby imparting a rocking motion to the occupant. Furthermore, such water chairs and couches usually employ water only in the horizontally disposed seat cushions, and not in the vertically disposed back cushions.

Accordingly, it is a primary objective of the present invention to provide an improved chair or couch having water-filled seat and back cushions.

Another objective of the present invention is the provision of water-filled chairs and couches wherein the firmness of the cushions can be adjusted.

A further objective of the present invention is the provision of a water-filled chair or couch which provides support for a person's lower back.

Still another objective of the present invention is the provision of a chair or couch having water filled cushions with a minimal wave effect.

Still a further provision of the present invention is the provision of a water filled chair or couch which is comfortable to sit in, economical to manufacture, and durable in use.

These and other objectives will become apparent from the following description of the present invention.

SUMMARY OF THE INVENTION

The chair or couch of the present invention generally includes a frame with a water-filled bladder positioned on the frame. The bladder has a seat portion and a back portion. The seat and back portions are interconnected by a channel extending substantially across the width of the bladder so that there is communication between the seat and back portions. The bladder is partially filled with water and is void of air such that, as a person sits into the chair or couch, water is instantaneously forced from the seat portion, through the channel, and upwardly into the back portion of the bladder. Thus, when a person sits down, the back portion expands and thereby provides support to the person's lower back.

The channel extends substantially across the width of the bladder, and has a depth which is substantially less than that of either the seat or back portions. Thus, the channel provides a restricted, yet unobstructed flow of water from the seat portion to the back portion of the bladder when a person sits down on the chair or couch. This construction of the channel allows the flow from the seat to the back portion to be instantaneous, while also minimizing the wave effect in the chair or couch.

A restrictor bar extends across the channel and has opposite ends secured to the frame or the chair or couch. This restrictor bar prevents the channel from expanding as water passes therethrough. The position of the restrictor bar on the frame may be adjustable, so as to permit adjustment of the depth of the channel, and thereby control the length of time required for water to pass from the seat portion to the back portion when a person sits on the seat portion.

A high density, soft foam dam provides support at the front edge of the seat portion of the bladder. A heating element is provided beneath the seat portion to heat the water in the bladder. A vibrator is positioned adjacent the back portion of the bladder for vibrating the bladder. The bladder includes an opening for adding or removing water so that the firmness of the chair or couch can be varied as individually desired. A fabric covers the bladder so that the chair or couch appears substantially the same a conventional chairs and couches having spring and/or stuffed cushions.

DETAILED DESCRIPTION OF THE DRAWINGS

Figure 1:
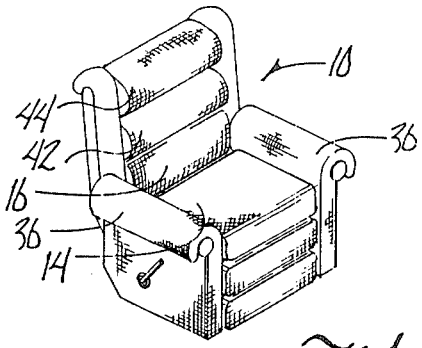
FIG. 1 is a perspective view of the water-filled chair of the present invention.

The reference numeral 10 generally designates a chair having a water bladder 12 therein, according to the present invention. It is understood that the water bladder 12 is not limited to use in a chair, but may also be used in a couch or loveseat. Preferably, the water-filled couch has three individual bladders 12 while a loveseat has two individual bladders, such that a person occupying the couch or loveseat will not be buoyed when another person sits on the couch or loveseat.

More particularly, bladder 12 includes a seat portion 14 and a back portion 16. The seat and back portions are interconnected by a channel 18 which provides communication between the seat and back portions. Channel 18 extends substantially across the width of bladder 12 and has a depth substantially less than that of the seat or back portions.

Figure 7:
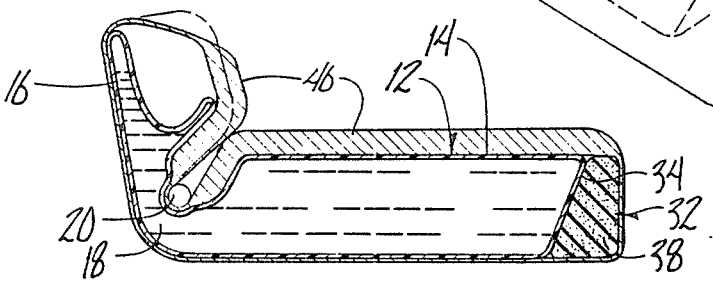
FIG. 7 is a sectional view showing the bladder in an unoccupied state.
Figure 8:
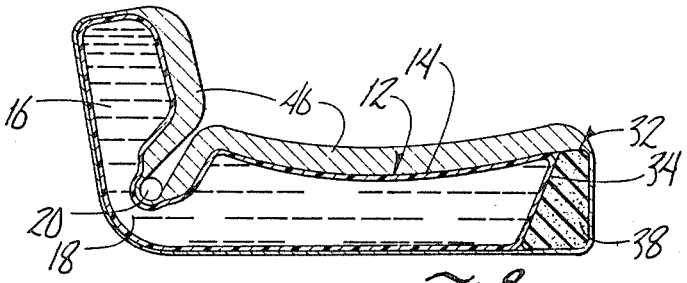
FIG. 8 is a side sectional view showing the shape of the bladder when the chair is occupied.

Bladder 12 is partially filled with water and is void of air. When chair 10 is unoccupied, the water is contained primarily in seat portion 14 and back portion 16 is collapsed, as best seen in FIG. 7. When a person sits down onto seat portion 14, the weight of the person forces water upwardly through channel 18 and into back portion 16, such that the back portion expands, as best seen in FIG. 8. Thus, back portion 16 provides support for the person's lower back.

Since channel 18 is open substantially across the width of bladder 12, the water flow from seat portion 14 to back portion 16 is substantially instantaneous when a person sits down. In other words, back portion 16 fills immediately with water so that the person does not experience a sinking effect into seat portion 14.

A restrictor bar 20 extends across channel 18 so as to prevent the channel from expanding when a person sits down. Thus, the restricted shape of the channel is maintained. Restrictor bar 20 has opposite ends which are removably secured to the frame 22 of the chair. More particularly, socket members 24 and 26 are mounted on chair frame 22 and is adapted to receive the ends of bar 20. At least one of socket members 24 or 26 has a C-shaped collar 28 with a downwardly presented mouth 30 through which the respective end of bar 20 can pass so that bar 20 is removable from the chair. Also, socket members 24 and 26 can be adjustably mounted on frame 22 by any convenient means such that the depth of channel 18 can be varied. Accordingly, the time required for water to pass from seat portion 14 into back portion 16 can be increased or decreased to satisfy the individual. It is also understood that socket members 24, 26 can be replaced by hooks or any other convenient means for securing the opposite ends of bar 20 to the chair frame 22.

Figure 6:
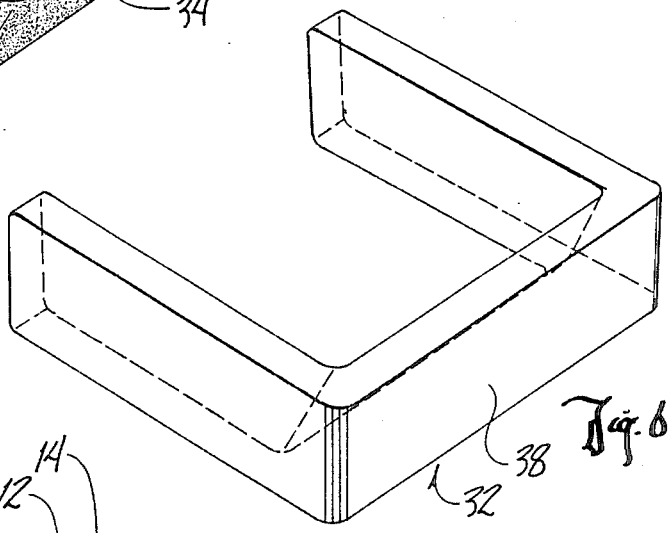
FIG. 6 is a perspective view of the foam dam.

A dam 32 extends at least across the front edge 34 of bladder 12 so as to maintain the shape of the bladder. Preferably, dam 32 is U-shaped, as shown in FIG. 6, and extends along the opposite sides of bladder 12 to further maintain the shape of the bladder. However, it is understood that the arms 36 of the chair will support the sides of bladder 12. As seen in the drawings, dam 32 includes a base portion 38 which is tapered from bottom to top so as to provide additional support along the lower front edge of the bladder. Preferably, dam 32 is made of high density, soft urethane foam.

Figure 5:
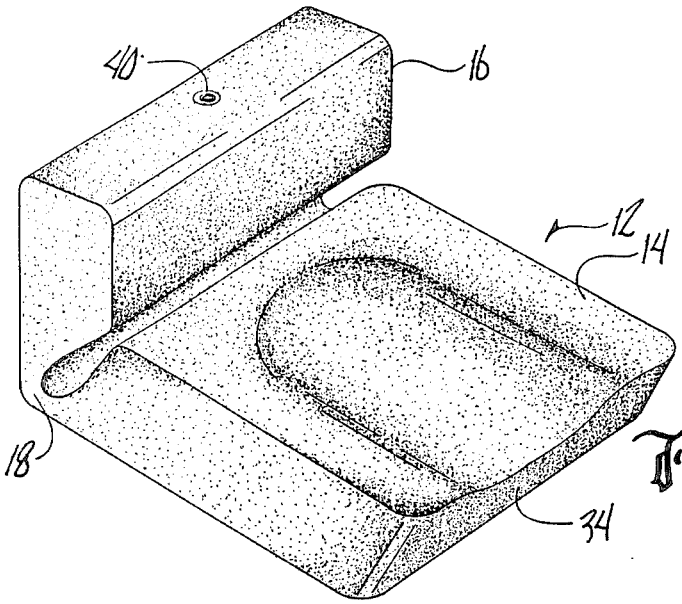
FIG. 5 is a perspective view of the bladder.

Bladder 12 has an opening with a closure cap 40 in any convenient location, such as in the top of back portion 16 as shown in FIG. 5, for adding or removing water to and from the bladder. Preferably, bladder 12 contains approximately 9–10 gallons of water. The firmness of chair 10 is directly related to the quantity of water within bladder 12. In other words, the chair becomes firmer as more water is added to bladder 12, and vice versa.

Chair 10 may also include a bladder 42 for the upper back and a bladder 44 for the person's head. Bladders 42 and 44 are partially filled with water and void of air. These bladders also have an inlet opening with a closure cap (not shown) to allow water to be added or removed from the bladder, so that the firmness thereof may be varied.

Figure 2:
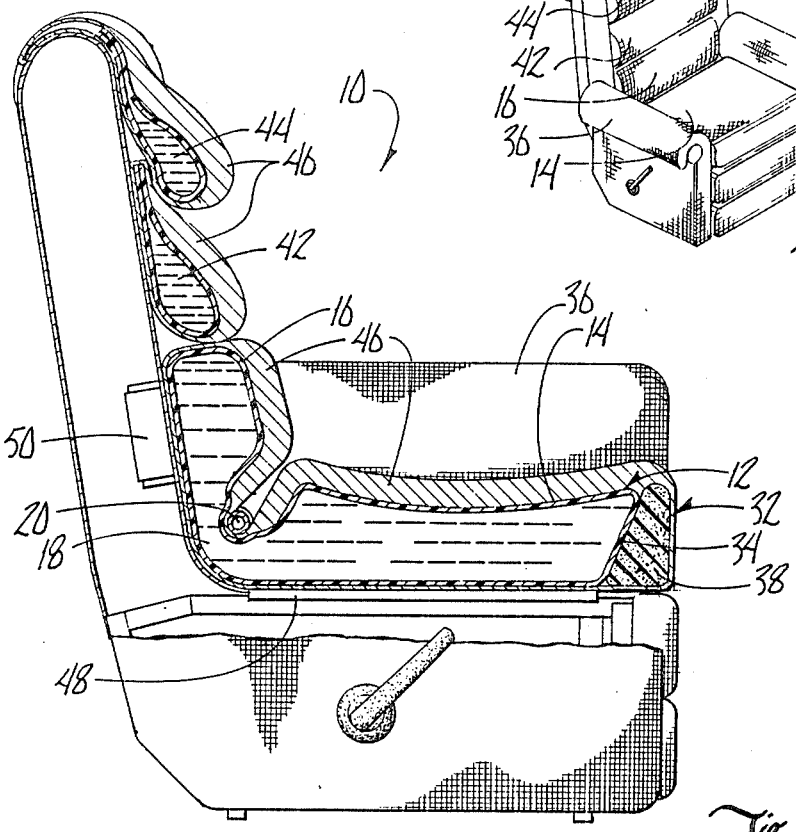
FIG. 2 is a side sectional view of the chair.
Figure 3:
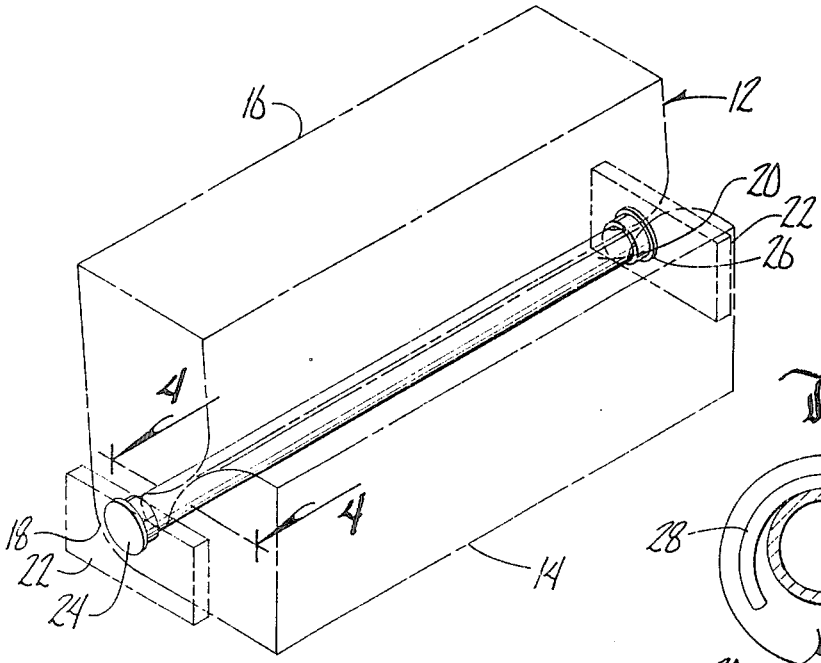
FIG. 3 is a partial perspective view showing the restrictor bar used to maintain the shape of the bladder.
Figure 4:
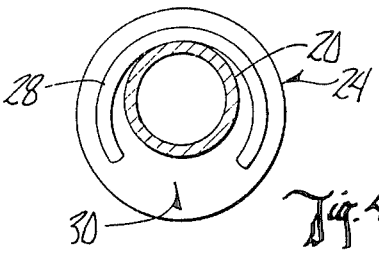
FIG. 4 is a sectional view taken along lines 4—4 of FIG. 3.

All of bladders 12, 42 and 44 are covered with a fabric material 46, such as Dacron, such that the chair is similar in appearance to conventional chairs having spring and/or stuffed cushions. Zippers or snaps are provided in fabric 46 such that the bladders can be removed therefrom if necessary. As seen in FIG. 2, fabric 46 also extends around dam 32.

A heating element 48 is mounted in chair 10 beneath seat portion 14 of bladder 12 such that the water therein can be heated. Also, a vibrator 50 is mounted in chair 10 adjacent back portion 16 of bladder 12 so as to provide soothing vibrations to a person's back.

From the foregoing, it is seen that the present invention accomplishes at least all of the stated objectives.

What is claimed is:

1. In piece of furniture for sitting, comprising:

a frame;

a bladder positioned on the frame and having a seat position, a back portion, the bladder being partially filled with liquid and void of air whereby liquid is forced substantially instatntaneously from the seat portion upwardly into the back portion of the bladder when a person sits down into the chair so that the back portion expands, thereby providing support to the person's lower back;

restrictor means extending the substantial width of the bladder between the seat and back portions to form a channel means for preventing the channel means from expanding as liquid passes therethrough and for maintaining a constant restricted depth of said channel means when the seat is occupied and unoccupied.

2. The furniture piece of claim 1 wherein the channel means is a single elongated passageway interconnecting the seat and back portions of the bladder.

3. The furniture piece of claim 1 wherein the restrictor means includes an elongated bar extending across the width of the bladder and engaging the bladder adjacent the channel means and having opposite ends removably secured to the frame.

4. The furniture piece of claim 3 wherein the frame has opposite sides each of which have a socket adapted to receive the ends of the restrictor bar.

5. The furniture piece of claim 4 wherein at least one of the sockets comprises a C-shaped collar having a downwardly presented mouth through which the respective end of the restrictor bar passes for installing and removing the bar to and from the furniture.

6. The furniture piece of claim 1 wherein the seat portions of the bladder has a front edge and opposite sides, the chair further comprising dam means extending at least across the front edge of the seat portion so as to provide support to the front edge.

7. The furniture piece of claim 6 wherein the dam means is U-shaped and also extends along each side of the seat portion.

8. The furniture piece of claim 6 wherein the dam means is constructed of high density, soft foam.

9. The furniture piece of claim 1 further comprising a heating element for heating the liquid in the bladder.

10. The furniture piece of claim 1 further comprising vibrator means for vibrating the bladder.

11. The furniture piece of claim 1 wherein the bladder includes an opening for adding or removing liquid and means for closing the opening.

12. The furniture piece of claim 1 wherein the bladder is covered with a fabric.

* * * * *